US005543072A

United States Patent [19]

Fost et al.

[11] Patent Number: 5,543,072

[45] Date of Patent: Aug. 6, 1996

[54] SYNTHETIC DETERGENT BARS AND METHOD OF MAKING THE SAME

[75] Inventors: Dennis L. Fost, Ridgewood; Joseph A. Komor, Ramsey, both of N.J.; Mario Novakovic, Kew Garden Hills, N.Y.

[73] Assignee: Mona Industries, Inc., Paterson, N.J.

[21] Appl. No.: 332,457

[22] Filed: Oct. 31, 1994

Related U.S. Application Data

[63] Continuation of Ser. No. 956,291, Oct. 5, 1992.

[51] Int. Cl.[6] ..... C11D 9/32; C11D 1/28

[52] U.S. Cl. ..... 510/151; 510/155; 510/156; 510/537; 510/497; 510/418; 510/474; 510/489; 510/491

[58] Field of Search ..... 252/174, 121, 252/171, 174.21, 550, 557, 551, 545, DIG. 16

[56] References Cited

U.S. PATENT DOCUMENTS

| | | | |
|---|---|---|---|
| 2,813,078 | 11/1957 | Vitalis | 252/161 |
| 2,894,912 | 7/1959 | Geitz | 252/121 |
| 3,206,408 | 9/1965 | Vitalis | 252/161 |
| 3,231,606 | 1/1966 | Fessler | 562/122 |
| 3,539,522 | 11/1970 | Lindner | 252/153 |
| 3,625,906 | 12/1971 | Alsbury et al. | 252/121 |
| 3,625,910 | 12/1971 | Sweeney et al. | 252/554 |
| 3,640,882 | 2/1972 | Groves, Jr. | 252/121 |
| 3,673,122 | 6/1972 | Woo | 252/555 |
| 3,766,097 | 10/1973 | Rosmarin | 252/552 |
| 3,793,215 | 2/1974 | Smith | 252/117 |
| 3,862,965 | 1/1975 | Werner et al. | 252/557 |
| 3,867,316 | 2/1975 | Frank et al. | 252/557 |
| 3,901,832 | 8/1975 | Dugan et al. | 252/557 |
| 3,926,863 | 12/1975 | Peria et al. | 252/557 |
| 3,989,647 | 11/1976 | Prince | 252/557 |
| 4,007,125 | 2/1977 | Prince | 252/121 |
| 4,012,341 | 3/1977 | Orshitzer et al. | 252/550 |
| 4,014,807 | 3/1977 | Werner et al. | 252/134 |
| 4,039,562 | 8/1977 | Bloch et al. | 252/546 |
| 4,092,259 | 5/1975 | Prince | 252/121 |
| 4,092,260 | 5/1978 | Prince | 252/117 |
| 4,094,807 | 6/1978 | Humphreys et al. | 252/131 |
| 4,096,082 | 6/1978 | Prince | 252/117 |
| 4,100,097 | 6/1978 | O'Roark | 252/557 |
| 4,110,239 | 8/1978 | Prince | 252/557 |
| 4,151,105 | 4/1979 | O'Roark | 252/557 |
| 4,180,470 | 12/1979 | Tokosh et al. | 252/557 |
| 4,191,704 | 3/1980 | Mather et al. | 558/38 |
| 4,211,675 | 7/1980 | Machin | 252/557 |
| 4,231,904 | 11/1980 | Machin | 252/557 |
| 4,246,129 | 1/1981 | Kacher | 252/174 |
| 4,268,424 | 5/1981 | Hall et al. | 252/174 |
| 4,273,684 | 6/1981 | Nagashima et al. | 252/174 |
| 4,278,571 | 7/1981 | Choy | 252/558 |
| 4,320,033 | 3/1982 | Yoshikawa | 252/174 |
| 4,328,131 | 5/1982 | Carson, Jr. et al. | 252/542 |
| 4,335,025 | 6/1982 | Barker et al. | 252/550 |
| 4,370,250 | 1/1983 | Joshi | 252/174 |
| 4,434,090 | 2/1984 | Hampson et al. | 252/547 |
| 4,469,613 | 9/1984 | Munteanu et al. | 252/174 |
| 4,515,707 | 5/1985 | Brooks | 252/174 |
| 4,681,914 | 7/1987 | Olson et al. | 252/174 |
| 4,692,261 | 9/1987 | Filomeno | 252/557 |
| 4,695,395 | 9/1987 | Caswell et al. | 252/121 |
| 4,705,644 | 11/1987 | Barone et al. | 252/135 |
| 4,707,288 | 11/1987 | Irlam et al. | 252/12 X |
| 4,725,376 | 2/1988 | Copeland | 252/174 |
| 4,735,746 | 4/1988 | Speranza et al. | 252/174 |
| 4,808,322 | 2/1989 | McLaughlin | 252/121 |
| 4,828,745 | 5/1989 | Jeschke et al. | 252/174 |
| 4,933,100 | 6/1990 | Ramachandran | 252/174 |
| 4,954,282 | 9/1990 | Rys et al. | 252/121 |
| 4,959,171 | 9/1990 | Pantini et al. | 252/174 |
| 5,002,685 | 3/1991 | Chambers et al. | 252/134 |
| 5,013,486 | 5/1991 | Joshi | 252/559 |
| 5,028,353 | 7/1991 | Simion et al. | 252/121 |
| 5,030,376 | 7/1991 | Lee et al. | 252/108 |
| 5,039,453 | 8/1991 | Joshi et al. | 252/540 |
| 5,041,243 | 8/1991 | Joshi | 252/534 |
| 5,043,091 | 8/1991 | Joshi et al. | 252/174.17 |
| 5,053,159 | 10/1991 | Joshi | 252/106 |
| 5,154,849 | 10/1992 | Visscher et al. | 252/117 |

FOREIGN PATENT DOCUMENTS

| | | |
|---|---|---|
| 0441652 | 2/1991 | European Pat. Off. . |
| 1370284 | 10/1970 | United Kingdom . |

*Primary Examiner*—Paul Lieberman
*Assistant Examiner*—Necholus Ogden
*Attorney, Agent, or Firm*—Franklyn Schoenberg; Norman E. Lehrer

[57] ABSTRACT

There is provided a mild detergent toilet bar (syndet bar) composition containing from at least 25 percent up to about 65 percent by weight of synthetic surface active agents, which lathers, foams and wears well, exhibits minimal slushing and curd-forming properties in all types of water, possesses good plasticity and tactile properties while also being mild and non-injurious to the user's skin and readily processed with conventional soap-making equipment. The syndet bar compositions contain a) from about 15 to 35 percent by weight of acyl esters of isethionic acid salts;

b) at least one sulfosuccinate in an amount from about 10 to about 30 percent by weight wherein the weight ratio of said acyl isethionate esters to sulfosuccinate is 0.5:1 to 2:1;

c) free fatty acid in an amount from about 25 to 40 percent by weight;

d) at least two percent up to about 10 percent by weight of an organic hydrophilic agent;

e) an organic binder/filler in an amount from about five percent up to about 20 percent by weight; and f) Water in an amount from about two to 10 percent by weight.

15 Claims, No Drawings

SYNTHETIC DETERGENT BARS AND METHOD OF MAKING THE SAME

This is a continuation of copending application Ser. No. 07/956,291 filed on Oct. 5, 1992.

FIELD OF THE INVENTION

The present invention relates to detergent compositions and, more particularly to detergent compositions in bar form (syndet bar) which are intended primarily for personal hygiene, commonly termed toilet bars.

BACKGROUND OF THE INVENTION

While synthetic detergents have widespread use in powdered and liquid form, until recently the use thereof has achieved only limited commercial success in displacing the familiar bars of household toilet or bath soaps. Synthetic detergents which are sufficiently inexpensive and have the requisite lathering and cleaning power make bars which are generally unsatisfactory due to high hygroscopicity, unsatisfactory solubility characteristics, extreme defatting action on the skin, poor working properties in standard soap machinery, brittleness and poor cohesion or excessive softness of the bar itself. For example, synthetic anionic surface active agents such as alkyl benzene sulfonates tend to produce a soft, sticky end product which is difficult to process and stamp into bars and the use of such materials in the production of solid detergent compositions is not desirable. More importantly, products produced therefrom are very irritating to the skin. In addition, conventional synthetic detergent bars generally tend to develop a very soft, sticky surface upon standing in contact with a wet surface and in many cases they do not possess adequate physical strength, readily cracking and crumbling during use.

There have been numerous attempts to replace soap with synthetic detergent toilet bars that overcome these shortcomings as well as to achieve a toilet bar which is mild and non-injurious to the skin while possessing good detergency and lathering quality when used on the skin and other surfaces in all types of water. A variety of synthetic detergents such as alkyl sulfates, alkane sulfonates, olefin sulfonates, mono-alkyl sulfosuccinates, coco methyl tauride and the like have been suggested for use in toilet bar compositions. These materials, although offering many advantages, are either too harsh in the ranges that they lather, require critical process conditions and special manufacturing equipment and, when toilet bars are prepared, the resulting product suffers severely in lathering characteristics and may be quite mushy.

Blending synthetic detergents with a binder system in an effort to formulate a mass with physical properties more like soap to overcome the problems of forming synthetic detergents into bars has also been attempted with some success. Ingredients generally constituting binder systems are wax-like, water insoluble fatty acids, fatty alcohols, mono-, di-, or triglycerides, fatty acid esters, particularly fatty acid esters with fatty alcohols, lanolin, petrolatum, etc.

More recently, the introduction of mild synthetic detergent toilet bars, especially those based on acyl isethionates such as sodium cocoyl isethionate as a primary ingredient, have met with growing commercial success. Such developments have been described, for example, in U.S. Pat. Nos. 3,901,832; 3,989,647; 4,007,125; 4,100,097; 4,110,239; 4,180,470; 4,211,675; 4,2311,904; 4,234,464, 4,268,424, 4,335,025, 4,959,171, 5,030,376, and EPO patent application 441,652. However, it is noted therein that such detergent bar formulations contain critical amounts and proportions of components and it is known that the toilet bars prepared therefrom generally exhibit disadvantages as to certain properties and manufacturing procedures. Accordingly, it is apparent that there is still a need for a toilet bar (syndet bar) made of conventional soap bar manufacturing equipment; lathers, foams, and wears well; exhibits minimal slushing and curd-forming properties in all types of water; possesses good plasticity and tactile characteristics and is mild and non-injurious to the user's skin.

SUMMARY OF THE INVENTION

It is accordingly an object of the present invention to prepare a synthetic detergent toilet bar (syndet bar) which lathers, foams and wears well; exhibits minimal slushing and curd-forming properties in all types of water; possesses good plasticity and tactile properties; is mild and non-injurious to the user's skin; and is readily processed with conventional soap-making equipment.

It is a further object of the present invention to provide a synthetic detergent toilet bar with enhanced lathering characteristics in all types of water and excellent skin mildness which is readily processed in a straightforward manner with conventional soap-making equipment.

It is a still further object of the present invention to provide synthetic detergent compositions suitable for being readily processed with conventional soap-making equipment into toilet bars (syndet bars) which lather, foam and wear well; exhibit minimal slushing and curd-forming properties in all types of water and are mild and non-injurious to a user's skin.

It is another object of the present invention to provide a straightforward process for preparing a synthetic detergent toilet bar which requires a minimal number of finishing steps to facilitate forming the toilet bar with conventional soap-making equipment.

It is yet another object of the present invention to provide an in-situ process for the preparation of a synthetic detergent composition which requires a minimal number of steps to facilitate forming of toilet bars with conventional soap-making equipment.

In accordance with the present invention there is provided a skin cleaning toilet bar composition comprising:

a) acyl esters of isethionic acid salts in an amount of from about 15 to about 35 percent by weight;

b) at least one sulfosuccinate in an amount of from about 10 to about 30 percent by weight, with the proviso that the weight ratio of acyl esters of isethionic acid salts to sulfosuccinate is between 0.5:1 and 2:1;

c) free fatty acid in an amount of from about 25 to about 40 percent by weight;

d) at least two percent by weight of an organic hydrophilic agent;

e) an organic binder/filler in an amount of from about five to about 20 percent by weight; and f) water in an amount from about two to about 10 percent by weight, wherein said toilet bar composition contains at least 25 percent up to about 65 percent, preferably about 30 to 50 percent, by weight of synthetic surface active agent components.

In another aspect of the present invention there are provided detergent containing compositions which are readily processible into skin cleaning toilet bars using conventional soap toilet bar equipment comprising:

a) acyl esters of isethionic acid salts in an amount of from about 15 to about 35 percent by weight;

b) at least one sulfosuccinate in an amount of from about 10 to about 30 percent by weight, wherein the weight ratio of acyl esters of isethionic acid salts to sulfosuccinate is between 0.5:1 and 2:1;

c) free fatty acid in an amount of from about 25 to about 40 percent by weight;

d) at least two percent by weight of an organic hydrophilic agent;

e) an organic binder/filler in an amount of from about five to about 20 percent by weight; and f) water in an amount from about two to about 10 percent by weight, wherein said compositions contain at least 25 percent up to about 65 percent by weight of synthetic surface active agent components.

In yet another aspect of the present invention there is provided a straightforward process for the in situ preparation of detergent compositions suitable for direct utilization in the processing of synthetic detergent toilet bars which comprises reacting at elevated temperatures a $C_8$-$C_{16}$ alkyl mono-ester of butenedioic acid with about a stoichiometric amount of an alkali metal sulfite in an aqueous dispersion of a molten fatty acid extender and an organic hydrophilic agent while said reaction mixture is maintained in a fluid state at a temperature between about 65° and 100° C.; admixing with said reaction mixture an acyl ester of isethionic acid salt in an amount between 0.5:1 and 2.0:1 based on the weight of sulfonated butenedioic acid esters in said reaction mixture and between about five and 20 percent by weight of an organic binder/filler; adjusting the moisture content of said admixture to about two to 10 percent, preferably four to eight percent, by weight; and then recovering the resulting detergent composition containing a homogeneous mono-alkyl sulfosuccinate-acyl isethionate admixture.

A detergent composition containing a mixture of monoalkyl sulfosuccinate and acyl isethionate is readily prepared in a straightforward way, preferably in situ, in accordance with the practice of the invention, which requires substantially no further finishing steps to facilitate the preparation of detergent toilet bars (syndet bars) on conventional soap finishing equipment. Moreover, syndet bars in accordance with the invention exhibit excellent lathering in all types of water, low wear rates, good tactile properties, minimal slushing and curd-forming properties in all types of water, as well as excellent mildness to a user's skin.

Other objects and advantages of the present invention will become apparent from the detailed description thereof taken in conjunction with the examples.

DETAILED DESCRIPTION OF THE INVENTION

According to the present invention there is provided a mild detergent toilet bar (syndet bar) composition containing from at least 25 percent up to about 65 percent, preferably 30 percent to 50 percent, by weight of synthetic surface active agents, which lathers, foams and wears well, exhibits minimal slushing and curd-forming properties in all types of water, possesses good plasticity and tactile properties while also being mild and non-injurious to the user's skin and readily processed with conventional soap-making equipment.

Syndet bar compositions of the invention comprise:

a) from about 15 to 35 percent by weight of acyl esters of isethionic acid salts;

b) at least one sulfosuccinate in an amount from about 10 to about 30 percent by weight wherein the weight ratio of said acyl isethionate esters to sulfosuccinate is 0.5:1 to 2:1;

c) free fatty acid in an amount from about 25 to 40 percent by weight;

d) at least two percent up to about 10 percent by weight of an organic hydrophilic agent;

e) an organic binder/filler in an amount from about five percent up to about 20 percent by weight; and f) Water in an amount from about two and 10 percent by weight, wherein the total weight of synthetic surface active agent in the composition is from at least 25 percent up to about 65 percent, preferably from about 30 percent to about 50 percent, by weight.

The surface active agent (synthetic detergent) components of the detergent toilet bar according to the present invention are aliphatic higher fatty acid esters of an alkali metal isethionic acid salt (acyl isethionates) in combination with at least one sulfosuccinate which can be any sulfosuccinate, either mono esters (half esters) or di-esters and any alkali metal, alkaline earth metal, amine or ammonium salt, but preferably a monoalkyl sulfosuccinate.

The acyl isethionates that may be employed herein are the water soluble aliphatic higher fatty acid esters of an alkali metal isethionic acid salt which can be defined by the following general formula:

$$RC00CH_2CH_2SO_3M$$

wherein R is an aliphatic radical or mixed aliphatic radical of a higher fatty acid or mixtures thereof, having from six to 22 carbon atoms and an iodine value of less than about 20; and wherein M is an alkali metal cation such as sodium, potassium or ammonium, or the cation of an organic amine base such as triethanolamine, triisopropanolamine, diethanolamine and monoethanolamine.

The acyl group of the isethionate ester salts is derived from fatty acids containing from about six to about 22 carbon atoms which can be obtained from natural or synthetic sources, preferably acids in the range of $C_{12}$-$C_{18}$ being used such as those derived from coconut fatty acids. The acids providing the acyl group are normally mixtures of long chain acids, examples of their natural sources being olive oil, palm kernel oil, tallow, fish oils and preferably coconut oil. The salts will usually be the sodium or potassium salts or mixtures thereof but salts of ammonia and alkyl ($C_1$ to $C_4$) substituted amine and alkanolamine may also be used.

The sulfosuccinates useful as the co-active surface active agent component of the compositions in accordance with the invention may be any sulfosuccinate, either monoesters (half esters) or di-esters and any alkali metal, alkaline earth metal, amine or ammonium salt, but the sulfosuccinates are preferably monoesters.

Monoalkyl sulfosuccinates suitable for use in the present invention are desirably formed by the reaction of a higher molecular weight alcohol with a butenedioic acid or anhydride, such as maleic anhydride or acid or fumaric acid. The high molecular weight alcohol can be a saturated or unsaturated aliphatic alcohol having six to 18 carbon atoms or alkoxylated aliphatic alcohols containing six to 18 carbon atoms and is, preferably, lauryl alcohol or a mixture of alcohols in which lauryl alcohol predominates. The monoalkyl ester is then reacted with a sulphite such as sodium sulphite to prepare the sulfosuccinate.

As indicated, the isethionate ester and sulfosuccinate admixture are the surface active agent components in the syndet toilet bar compositions of the invention with the acyl isethionate being present in an amount ranging from about 15 percent to about 35 percent by weight and the sulfosuccinate being present in an amount ranging from about 10 percent to about 30 percent by weight, wherein the weight ratio of said acyl isethionate to sulfosuccinate ranges from about 0.5:1 to 2:1, and preferably from about 0.75:1 to 1.5:1.

In an advantageous embodiment, the composition of the syndet bar can also contain up to about five percent by weight of an alkali metal salt of a dialkyl sulfosuccinate such as sodium dihexyl sulfosuccinate. The addition of such component surprisingly serves as an instantaneous foam booster, which is particularly useful in compositions containing a wide variety of supplemental ingredients conventionally added to toilet bars such as emollients, ingredients conventionally added to toilet bars such as emollients, perfumes, colorants, dyes, pigments and the like.

Important components of the syndet toilet bar compositions of the present invention also include free fatty acid, organic hydrophilic agent, organic binder/filler and water components when coupled with the surface active agent components.

Long chain free fatty acids of about eight to 22, preferably 12 to 18, carbon atoms and mixtures thereof are incorporated within the compositions of the invention in an amount between about 25 and 40 percent, preferably 33 to 37 percent, by weight. Suitable fatty acids include stearic acid, palmitic acid, coconut fatty acid and mixtures thereof.

Organic hydrophilic agents are extremely important components of the compositions of the invention and should be present in an amount ranging from at least two percent to about 10 percent, preferably to about seven percent, by weight. These materials serve as agents for controlling the viscosity and physical texture of the syndet composition during the preparation thereof as well as assisting in the sulfonation step during the in situ process for preparation of the syndet composition as hereinafter described.

Organic hydrophilic agents suitable for use are substantially non-volatile aliphatic polyhydric alcohols having at least two active hydrogens up to about four active hydrogens, and/or polyoxyalkylene polymers such as polyalkoxylated derivatives of compounds having at least one active hydrogen up to six or even more active hydrogen atoms and mixtures of the same. Suitable polyoxyalkylene polymers may be made by processes well known in the art wherein up to 50 moles of ethylene oxide or mixtures of ethylene oxide and propylene oxide or higher alkylene oxide are reacted with a compound having at least one active hydrogen atom such as water, monohydroxylic alcohol such as ethanol and The polyoxyalkylene polymers of such reaction will have linear or branched oxyethylene or oxyethylene-higher oxyalkylene chains and such chains will terminate with hydroxylic groups.

Exemplary suitable hydrophilic agents are propylene glycol, and polyethylene glycol and alkoxylated glucose derivatives such as those commercially available under the tradename Glucam from Amerchol, Polyglycol E-400 from Dow Chemical Co. and UCON 50-HB- 660 Lubricant and Carbowax 400 from Union Carbide Corp.

The binder/filler component is, in general, a modified powdered hydrolyzed starch which should be present in an amount ranging from about five percent up to about 20 percent by weight and preferably in an amount ranging from about seven percent to about 12 percent by weight.

The water content is required to effect necessary processability over soap line equipment. The water content varies with the binder/filler and the hydrophilic agents. Preferably, water is present in an amount ranging from about two percent to about 10 percent, most preferably four to eight percent, by weight.

Sodium chloride is optionally included. It is used, for example, in an amount ranging up to about two percent by weight, for processing purposes and is generally added as a premix with the water.

Other ingredients and adjuncts may be needed or employed with the syndet toilet bar compositions of the invention. The amount of these ingredients and adjuncts may range from about zero (0) percent to about 20 percent by weight of the total composition. For example, there may be included humectants such as glycerin, germicides, perfumes, colorants, dyes, soap and the like.

Detergent compositions which can be processed using conventional soap-line equipment to form syndet toilet bars of the invention may be prepared by a variety of well known mixing procedures, but detergent compositions of the invention particularly suitable for use, permitting direct utilization in the processing of syndet toilet bars, are preferably made in situ in accordance with the invention as hereinafter described.

Pursuant to the process of the present invention, the detergent compositions are prepared wherein the $C_8$-$C_{16}$ alkylsulfosuccinate component is prepared in situ at elevated temperature in an aqueous dispersion of a molten long chain fatty acid having 8 to 22, preferably 12 to 18, carbon atoms or mixtures thereof, a substantially non-volatile organic hydrophilic agent or mixtures thereof, and water. The acyl isethionate component together with the organic binder/filler are then admixed with the sulfosuccinate reaction mixture. It is important that the reaction mixture is maintained in a fluid state at all times until the detergent containing reaction product is recovered for storage, shipping or processing into syndet toilet bars.

The $C_8$-$C_{16}$ alkyl sulfosuccinate component is prepared in situ by reacting a corresponding $C_8$-$C_{16}$ alkyl mono-ester of butenedioic acid with an alkali metal sulfite in an aqueous dispersion of molten fatty acid and organic hydrophilic agent while the reaction mixture is maintained in a fluid state. The alkali metal sulfite is preferably employed in about a stoichiometric amount relative to the butenedioic acid ester reactant, to avoid any significant excess of butenedioic acid or alkali metal sulfite in the reaction mass.

The butenedioic acid ester in flake, granular or pre-molten liquid form is added to a previously prepared admixture of fatty acid and organic hydrophilic agents which has been heated to about 80° C., and a preheated charge of water or water and sodium chloride is then admixed therewith. The admixture is maintained in a fluid state throughout at a temperature up to about 80° C. The amount of water present in the reaction admixture should be sufficient to allow complete sulfonation of the butenedioic sufficient to allow complete sulfonation of the butenedioic intermediate by the alkali metal sulfite, generally up to about five to 15 percent by weight of the reaction mixture.

Sulfonation of the butenedioic acid ester according to the present invention is achieved by admixing the alkali metal sulfite reactant, preferably all at once, with the aqueous butenedioic acid ester/fatty acid/hydrophilic agent dispersion while the reaction admixture is maintained in a fluid state at an elevated temperature, although it can be added at a controlled rate. Adequate mixing is used to assure complete reaction of the reactants and control of the reaction temperature, in view of the exothermic nature of the reaction. Control of the temperature is required to avoid temperatures above about 100° C., a temperature of about 90° C.±5° C. being maintained during a so-called digestion period, usually about 30 to 90 minutes, after complete addition of the alkali metal sulfite to the aqueous butenedioic acid ester dispersion.

After complete addition of the alkali metal sulfite, the exotherm will result in a rise of the temperature of the reaction mixture. As indicated, agitation of the reaction mixture while controlling the temperature at up to 100° C. will assure complete mixing and sulfonation of the butenedioic acid ester. After exotherm, the temperature will begin to decrease. The temperature of the reaction mixture is then maintained at about 85° to 90° C. while continuing to agitate the reaction mixture until sulfonation is completed, about one hour.

Critical to the present invention are the fatty acid and organic hydrophilic components and their concentrations, when coupled with the butenedioic acid ester/alkali metal sulfite reaction mixture. Processability of the reaction mixture prepared as above disclosed is largely dependent upon correlation of the concentration of all these components in order to maintain a temperatures throughout the procedure as well as the ultimate processability of the syndet composition into toilet bars.

Following the completion of the sulfonation step, the acyl isethionate detergent is added to the reaction mixture together with the organic binder/filler component while maintaining the fluid state and temperature of the reaction mixture. The acyl isethionate, such as sodium cocoylisethionate, and organic binder/filler, such as modified starch, are gradually added while the reaction mixture is agitated without excessive aeration until a homogeneous mixture is obtained. As indicated, an alkali metal salt of a dialkyl sulfosuccinate such as sodium dihexyl sulfosuccinate may optionally be included in the compositions of the invention which ingredient would also be gradually added to the reaction mixture while it is maintained in a fluid state.

The moisture content of the reaction admixture is then adjusted to about seven percent by weight, if necessary, before transferring for further processing, such as transferring to a pre-chilled drum for flaking.

Several conventional methods may be used to form syndet toilet bars from the syndet composition of the present invention produced as hereinabove described. For example, the reaction mass while still fluid is, as indicated, poured onto a chill-roll and the resulting flakes can then be processed in a soap plodder which yields an extrusion mass from which a syndet toilet bar is stamped. Alternatively, the fluid reaction mass may be cast on trays, allowed to solidify, removed and then milled several times on a roller mill. The resultant milled flakes are subsequently put though a soap plodder, and the extruded material is pressed into toilet bars.

The present invention will best be understood from the following examples which are intended to be illustrative of preferred embodiments of the invention, but not in any way limiting thereof.

EXAMPLE 1

30.4 parts of stearic acid, 2.0 parts of coconut oil fatty acid, 14.4 parts of maleic acid, lauryl half ester and 3 parts of CARBOWAX 400 are melted together at 75° C.–80° C. while agitating the mixture. A mixture of water and salt (NaCl) is separately prepared and heated to 75°–80° C. and six parts of the preheated water containing about 0.5 parts of salt is admixed with the melted charge. The temperature of the reaction mixture is adjusted to 80° C.±5° C. and six parts of sodium sulfite is then added all at once with agitation. The temperature of the reaction mixture starts to rise and is maintained at about 95° C.

After a hold period of one hour, the reaction mixture is analyzed for unreacted sodium sulfite. When the reaction is completed, five parts of sodium dihexyl sulfosuccinate, 20 parts of sodium cocoyl isethionate and 10 parts of maltodextrin (hydrolyzed starch) are gradually admixed with the reaction mixture while the temperature is maintained at 80°–85° C. Agitation of the reaction mixture is continued until the mass becomes homogeneous. The moisture content of the admixture is then adjusted to six to eight percent and the product is transferred to a cooled flaker drum.

The syndet composition flakes that are prepared can be readily processed into syndet toilet bars using conventional toilet bar equipment or stored for later processing into syndet toilet bars.

EXAMPLES 2 TO 6

Using the procedure of Example 1, five syndet compositions are prepared using the following proportion of ingredients:

| | PERCENT BY WEIGHT | | | | |
|---|---|---|---|---|---|
| Example | 2 | 3 | 4 | 5 | 6 |
| Stearic Acid | 36.40 | 36.40 | 28.50 | 35.40 | 27.30 |
| Coco Fatty Acid | — | — | 2.00 | — | — |
| Glucose alkoxylate* | — | — | 2.80 | — | — |
| Sorbitol 70% | — | — | — | 2.10 | — |
| UCON Fluid 50-HB-660 | — | 2.10 | — | — | — |
| Propylene Glycol | 2.10 | — | — | — | — |
| PEG 400** | — | — | 2.80 | — | 5.30 |
| Maleic Acid, Lauryl Half ester | 14.30 | 14.30 | 12.70 | 14.20 | 12.80 |
| Water | 8.40 | 8.40 | 11.30 | 9.60 | 11.90 |
| NaCl | 0.50 | 0.50 | 0.50 | 0.50 | 0.50 |
| $Na_2SO_3$ | 6.00 | 6.00 | 5.40 | 6.00 | 5.20 |
| I-78*** | 22.20 | 22.20 | 24.50 | 22.20 | 23.80 |
| Modified Starch | 10.10 | 10.10 | 9.40 | 10.00 | 9.10 |
| KOH 45% | — | — | 0.30 | — | 0.60 |

*Glucam E-20 (AMERCHOL)
**Dow Chemical
***Sodium Cocoylisethionate
Example 2: Viscosity Low, Acceptable
Example 3: Viscosity Acceptable
Example 4: Viscosity Adequate
Example 5: Viscosity High, unsuitable
Example 6: Viscosity Lower Than Standard but acceptable

What is claimed is:

1. A skin cleaning toilet bar composition consisting essentially of:

a) water soluble acyl esters of isethionic acid salts in an amount of from about 15 to about 35 percent by weight;

b) at least one monoalkyl sulfosuccinate in an amount of from about 10 to about 30 percent by weight with the proviso that the weight ratio of acyl esters of isethionic acid salts to sulfosuccinate is between 0.5:1 and 2:1;

c) free fatty acid in an amount of from about 25 to about 40 percent by weight;

d) at least two percent up to 10 percent by weight of an organic hydrophilic agent selected from the group consisting of polyalkoxylate derivatives of compounds having at least one active hydrogen up to 6 active hydrogens and mixtures of the same;

e) a modified hydrolyzed starch organic binder in an amount of from about five to about 20 percent by weight; and f) water in an amount from about two to about 10 percent by weight, wherein said toilet bar composition contains at least 25 percent up to about 65 percent by weight of synthetic surface active agent components.

2. The skin cleaning toilet bar composition as claimed in claim 1, wherein said water soluble acyl esters of isethionic acid salts are aliphatic higher fatty acid esters of an alkali metal isethionic acid salt which can be defined by the following general formula:

$$RC00CH_2CH_2SO_3M$$

wherein R is an aliphatic radical or mixed aliphatic radical of a higher fatty acid or mixtures thereof, having from six to 18 carbon atoms and an iodine value of less than about 20; and wherein M is an alkali metal cation or the cation of an organic amine of triethanolamine, triisopropanolamine, diethanolamine or monoethanolamine.

3. Detergent containing compositions which are readily processible into skin cleaning toilet bars using conventional soap toilet bar equipment comprising: a composition in a form processable into syndet toilet bars on conventional soap toilet bar equipment consisting essentially of;

a) water soluble acyl esters of isethionic acid salts in an amount of from about 15 to about 35 percent by weight;

b) at least one monoalkyl sulfosuccinate in an amount of from about 10 to about 30 percent by weight, wherein the weight ratio of acyl esters of isethionic acid salts to sulfosuccinate is between 0.5:1 and 2:1;

c) free fatty acid in an amount of from about 25 to about 40 percent by weight;

d) at least two percent up to about ten percent by weight an organic hydrophilic agent selected from the group consisting of polyalkoxylate derivatives of compounds having at least one active hydrogen up to 6 active hydrogens and mixtures of the same;

e) a modified hydrolyzed starch in an amount of from about five to about 20 percent by weight; and f) water in an amount from about two to about 10 percent by weight, wherein said compositions contain at least 25 percent up to about 65 percent by weight of synthetic surface active agent components.

4. The detergent containing composition as claimed in claim 3, wherein said water soluble acyl esters of isethionic acid salts are aliphatic higher fatty acid esters of an alkali metal isethionic acid salt which can be defined by the following general formula:

$$RC00CH_2CH_2SO_3M$$

wherein R is an aliphatic radical or mixed aliphatic radical of a higher fatty acid or mixtures thereof, having from six to 18 carbon atoms and an iodine value of less than about 20; and wherein M is an alkali metal cation or the cation of an organic amine base of triethanolamine, triisopropanolamine, diethanolamine and monoethanolamine.

5. The detergent containing composition as claimed in claim 3, wherein said composition also contains an alkali metal salt of a dialkyl sulfosuccinate in an amount sufficient to serve as a foam booster for said detergent composition.

6. The skin cleaning toilet bar composition as claimed in claim 1, wherein said toilet bar composition also contains an alkali metal salt of a dialkyl sulfosuccinate in an amount sufficient to serve as a foam booster for said toilet bar composition.

7. The skin cleaning toilet bar composition as claimed in claim 1, wherein said toilet bar composition contains between 30 and 50 percent by weight of synthetic surface active agent compounds and said weight ratio of said acyl esters of isethionic acid salts to sulfosuccinate is between 0.5:1 and 1.5:1.

8. The skin cleaning toilet bar composition as claimed in claim 1, wherein said water soluble acyl esters of isethionic acid salts are $C_{12}$-$C_{18}$ acylisethionates.

9. The detergent containing compositions as claimed in claim 3, wherein said acyl water soluble esters of isethionic acid salts are $C_{12}$-$C_{18}$ acylisethionates.

10. The detergent containing composition as claimed in claim 9, wherein said composition also includes an alkali metal salt of a dialkyl sulfosuccinate in an amount sufficient to serve as a foam booster for said detergent composition.

11. The detergent containing composition as claimed in claim 10, wherein said composition includes an alkali metal salt of a dialkyl sulfocuccinate in an amount up to about five percent by weight.

12. The detergent containing composition as claimed in claim 3, wherein said composition is in a substantially flowable particulate form.

13. The detergent containing compositions as claimed in claim 3, wherein the compositions in a form processable into toilet bars are prepared in situ in liquid form.

14. The detergent containing compositions as claimed in claim 13, wherein the monoalkyl sulfosuccinate component of the composition is formed in situ by the reaction of a corresponding $C_8$ -$C_{16}$ alkyl mono-ester of butenedioic acid with an alkali metal sulfite in an aqueous dispersion of molten fatty acid and organic hydrophilic agent while maintaining the reaction mixture in a liquid state.

15. The skin cleaning toilet bar composition as claimed in claim 1, wherein the toilet bar product lathers, foams and wears well, exhibits minimal slushing and curd-forming properties in all types of water, possesses good plasticity and tactile characteristics and is mild and non-injurious to a user's skin.

* * * * *